US010460866B2

(12) United States Patent
Ettl

(10) Patent No.: US 10,460,866 B2
(45) Date of Patent: Oct. 29, 2019

(54) REPLACEMENT TRANSFORMER WITH MODULAR CONSTRUCTION

(71) Applicant: SIEMENS AKTIENGESELLSCHAFT, Munich (DE)

(72) Inventor: Christian Ettl, Weiz (AT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/159,350

(22) Filed: May 19, 2016

(65) Prior Publication Data

US 2017/0316864 A1 Nov. 2, 2017

(30) Foreign Application Priority Data

Apr. 29, 2016 (DE) ..... 10 2016 207 393

(51) Int. Cl.

| | |
|---|---|
| ***H01F 27/10*** | (2006.01) |
| ***H01F 30/12*** | (2006.01) |
| ***H01F 27/02*** | (2006.01) |
| ***H01F 27/29*** | (2006.01) |
| ***H01F 27/12*** | (2006.01) |
| ***H01F 27/04*** | (2006.01) |

(Continued)

(52) U.S. Cl.

CPC ..... *H01F 27/12* (2013.01); *H01F 27/002* (2013.01); *H01F 27/025* (2013.01); *H01F 27/04* (2013.01); *H01F 27/29* (2013.01); *H01F 27/40* (2013.01); *H01F 30/10* (2013.01)

(58) Field of Classification Search

CPC ..... H01F 27/12; H01F 27/40; H01F 27/025; H01F 27/04; H01F 27/29; H01F 30/10; H01F 27/10; H01F 27/105; H01F 27/125; H01F 27/14; H01F 27/16; H01F 27/321; H01F 27/322; H01F 30/12; H01F 30/14; H01F 2038/125

USPC ..... 336/57, 90, 58, 94, 5; 307/64, 83; 455/574

See application file for complete search history.

(56) References Cited

U.S. PATENT DOCUMENTS 1,500,837 A * 7/1924 Moody ..... H01F 27/002 137/316
1,693,265 A * 11/1928 Austin ..... H01F 27/14 174/12 R (Continued)

FOREIGN PATENT DOCUMENTS

AT 378623 B 9/1985
DE 944507 C 6/1956

(Continued)

*Primary Examiner* — Mang Tin Bik Lian
(74) *Attorney, Agent, or Firm* — Laurence Greenberg; Werner Stemer; Ralph Locher

(57) ABSTRACT

A configuration for the rapid replacement of a faulty multiphase transformer includes a plurality of single-phase transformers each of which has a housing filled with an insulating fluid and in which a core having a higher-voltage and a lower-voltage winding is disposed. At least one bushing socket is connected by a winding connection lead extending within the housing to the higher-voltage or lower-voltage winding. At least one high-voltage feed-through or bushing can be inserted into the bushing socket and a cooling module, which can be detachably connected to the housing and is filled with insulating fluid, cools the insulating fluid.

14 Claims, 9 Drawing Sheets

(51) Int. Cl.

| | |
|---|---|
| ***H01F 27/40*** | (2006.01) |
| ***H01F 30/10*** | (2006.01) |
| ***H01F 27/00*** | (2006.01) |

(56) References Cited

U.S. PATENT DOCUMENTS

| | | | | | |
|---|---|---|---|---|---|
| 1,859,969 | A | * | 5/1932 | Jansson | H01F 27/40 218/91 |
| 3,235,823 | A | * | 2/1966 | Renberg, Jr. | H01F 27/002 29/602.1 |
| 3,273,053 | A | * | 9/1966 | Allen | H01F 27/40 307/17 |
| 3,369,166 | A | | 2/1968 | Lake | |
| 3,462,645 | A | * | 8/1969 | Leonard | H01F 27/04 174/153 R |
| 3,541,487 | A | | 11/1970 | Leonard | |
| 3,621,426 | A | * | 11/1971 | Bennon | H01F 27/002 336/58 |
| 4,185,688 | A | | 1/1980 | Wiater et al. | |
| 4,456,899 | A | | 6/1984 | Matthes | |
| 4,549,817 | A | | 10/1985 | Felber | |
| 2009/0000763 | A1 | | 1/2009 | Bercea et al. | |
| 2011/0273255 | A1 | * | 11/2011 | Thompson | H01F 27/02 336/94 |
| 2011/0298287 | A1 | * | 12/2011 | Cobb | H01F 27/002 307/64 |

FOREIGN PATENT DOCUMENTS

| | | | |
|---|---|---|---|
| DE | 1971624 | U | 11/1967 |
| DE | 2224541 | A1 | 11/1973 |
| DE | 3025661 | A1 | 2/1982 |
| DE | 211012 | A1 | 6/1984 |
| DE | 102004054180 | A1 | 5/2006 |
| DE | 102007022641 | A1 | 11/2008 |

* cited by examiner

REPLACEMENT TRANSFORMER WITH MODULAR CONSTRUCTION

BACKGROUND OF THE INVENTION

Field of the Invention

The invention relates to an arrangement for replacing a multiphase transformer.

In electrical supply networks carrying alternating current, transformers are used to convert a higher voltage to a lower voltage or vice versa. Large power transformers, in particular, are often the size of an apartment building. Moreover, the transformers are designed to match the respective customer requirements and are therefore usually manufactured as individual tailor-made products. In the event of a fault, such transformers represent a critical component for the reliability of the network supply since the power supply is interrupted by the failure of the transformer. To enable the faulty transformer to be replaced, a replacement transformer must be designed—an involved process—and produced to meet the requirements. This can lead to delays of up to a year and more. Owing to its high weight and its size, transportation of the replacement transformer is furthermore time-consuming and can take several weeks, depending on weather conditions. Further delays arise on-site owing to long commissioning times.

BRIEF SUMMARY OF THE INVENTION

It is therefore the object of the invention to provide an arrangement with which faulty transformers can be rapidly replaced. A commissioning time of between 48 and 72 hours should preferably be possible.

The invention achieves this object by means of an arrangement having a plurality of single-phase transformers. The single-phase transformers each have a housing, which is filled with an insulating fluid and in which a core having a higher- and a lower-voltage winding is arranged, at least one bushing socket, which is connected by a winding connection lead extending within the housing to the higher- or lower-voltage winding, at least one high-voltage bushing, which can be inserted into the bushing socket, and a cooling module, which can be connected detachably to the housing and is filled with insulating fluid, for cooling the insulating fluid.

According to the invention, an arrangement is provided by means of which a multiphase transformer can be replaced quickly and easily, allowing the supply of power to be resumed quickly. The arrangement according to the invention can be transported quickly and installed on-site within a few days. Once the arrangement according to the invention is in operation, the faulty multiphase transformer can be replaced at leisure by a new transformer. Once the faulty multiphase transformer has been replaced by a new multiphase transformer, after three years for example, the arrangement according to the invention can be dismantled and is available for reuse.

To enable as quick as possible transportation to the faulty transformer, a modular construction has been chosen in the context of the invention. Thus, instead of a replacement transformer that has multiple phases and is therefore heavy, a plurality of single-phase and therefore lighter transformers is provided. Here, the number of single-phase transformers corresponds to the number of phases of the faulty transformer. In other words, a three-phase transformer is replaced by three single-phase transformers, for example. Here, the single-phase transformers themselves are also of modular construction. As a first module, the housing filled with insulating fluid is provided, in which the core with the higher- and lower-voltage windings is arranged as the active component. In principle, any desired construction of the core and of the higher- and lower-voltage windings is possible within the scope of the invention.

The housing is furthermore equipped with bushing sockets, which are connected at the end adjacent to the insulating fluid to a winding connection lead. The winding connection lead, in turn, is connected to one of the windings. If this is a bushing socket on the higher-voltage side, for example, the winding connection lead is connected to the higher-voltage winding. However, if this is a bushing socket on the lower-voltage side, for example, it is connected to the lower-voltage winding by the winding connection lead.

According to the invention, a plug-in high-voltage bushing is provided as a further module. The high-voltage bushing comprises an insulator extending in a longitudinal direction, through which, in turn, a high-voltage conductor extends. In this case, the high-voltage bushing has a fastening connection, from which an insertion section complementary in shape to the bushing socket extends to its free transformer-side end. During assembly, the insertion section is introduced into the bushing socket. The high-voltage bushing is then fixed on the housing by means of the fastening connection. In the inserted position, the high-voltage conductor of the bushing rests on a line stud, which is held in insulated fashion on the closed end of the bushing socket. The line stud makes contact with the winding connection lead and projects through the otherwise nonconductive inner wall of the bushing socket. The bushing sockets have sealing means and thus seal off the interior of the housing in a fluid-tight manner.

It is expedient if the column section extends perpendicularly or at right angles to a horizontal housing cover of the housing, ensuring that the weight of the high-voltage bushing is introduced into the bushing socket directly from above, i.e. perpendicularly. The dead weight of the bushing thus ensures a high contact force within the socket, and therefore good insulation by a solid body joint is provided in this way. It is advantageous if the high-voltage bushing is connected to the bushing socket by means of a suitable releasable connection, e.g. a screwed connection.

Finally, within the scope of the invention, a cooling module that can be transported independently of the other components of the respective single-phase transformer is provided, which module can be connected detachably to the housing and is or can be filled with insulating fluid even before installation on-site. Once the cooling module has been connected to the interior or the oil chamber of the housing, the insulating fluid is passed via the cooling module and thus cooled in the desired manner.

By virtue of the modular construction, a plurality of lighter modules or components is provided within the scope of the invention instead of a central unit that is very heavy and very difficult to transport, it being possible to transport these modules or components easily, at low cost and quickly to any desired location. By virtue of the plug-in configuration of the high-voltage bushing and of the bushing sockets, rapid assembly is furthermore made possible on-site.

In an advantageous embodiment of the invention, both the housing and the cooling module have at least one cooling fluid inlet and at least one cooling fluid outlet, which can be connected to one another for the exchange of insulating fluid, wherein each cooling fluid outlet and each cooling fluid inlet is equipped with a fluid-tight closing valve. By virtue of the fact that both the cooling module and the housing are equipped with a closing valve, these modules can be filled with an insulating fluid, e.g. a conventional insulating oil, even before they are assembled. During assembly, each cooling fluid outlet of the housing is connected to a cooling fluid inlet of the cooling module, and each cooling fluid outlet of the cooling module is, of course, connected to an associated cooling fluid inlet of the housing. In this way, the insulating fluid heated by the active part of the housing, i.e. the core and the higher- and lower-voltage windings, can be passed via the cooling module and thus cooled.

In principle, the cooling module can be of any desired design. Thus, for example, the cooling module can be a passive cooling module that has cooling fins in which the insulating fluid is circulated. On the outside of the cooling fins, the cooling module is in heat-conducting contact with the external atmosphere, and there is therefore heat transfer from the insulating fluid to the external atmosphere.

For the direct connection of a cooling fluid outlet to a cooling fluid inlet, it is possible, within the scope of the invention, to consider a simple flange connection with sealing means, for example. The connection between the cooling fluid inlet and the cooling fluid outlet is made directly, for example, in other words each cooling fluid inlet is in direct contact with a cooling fluid outlet in this embodiment of the invention.

In an advantageous embodiment of the invention, however, an intermediate piece for the fluid-tight connection of the cooling fluid outlet and the cooling fluid inlet is provided, wherein the intermediate piece delimits a connecting channel and has a bleed opening for bleeding the connecting channel. In this embodiment of the invention, the insulating fluid which emerges from a cooling fluid outlet is passed via the connecting channel of the intermediate piece to a cooling fluid inlet. The intermediate piece simplifies the mounting of the cooling module on the housing even further. The intermediate piece can be of rigid design or can have a flexible, movable section. The connecting channel, which is tubular for example, extends from an inlet opening of the intermediate piece to the outlet opening thereof. During assembly, the intermediate piece is connected in a fluid-tight manner at one end to a cooling fluid inlet and at the other end to a cooling fluid outlet. To prevent any air and/or moisture from getting into the insulating fluid, the connecting channel of the intermediate piece can be bled. This is accomplished via the bleed opening and, for example, by applying a vacuum in the connecting channel with the aid of a vacuum pump. After the application of the vacuum in the connecting channel, the closing valves of the cooling fluid inlet and of the cooling fluid outlet can each be opened. In one variant, the intermediate piece has a drain opening that can be closed in a fluid-tight manner and allows insulating fluid to be drained out of the connecting channel before assembly.

According to a preferred embodiment, each single-phase transformer of the arrangement according to the invention has an expansion tank, which can be connected to the housing via a connection for the exchange of insulating fluid, wherein the expansion tank is arranged on a separate holding frame. In other words, the expansion tank is held mechanically by its separate holding frame. Like the cooling module, the expansion tank is also connected to the interior of the housing or, in other words, the oil chamber, allowing insulating fluid to reach the expansion tank and vice versa via said connection. The volume of the insulating fluid is temperature-dependent. If the temperature rises, the volume of the insulating fluid increases. Owing to the constant internal volume of the housing, an additional volume in the form of the expansion tank is therefore required in order to absorb the additional volume of the insulating fluid that comes about at higher temperatures. The expansion tank can be equipped with an air dehumidifier or a gas compression chamber or the like. The precise embodiment of the expansion tank is a matter of choice in the context of the invention. The essential point, however, is the separate arrangement and holding on the holding frame. This ensures simple and quicker assembly.

According to a development which is expedient in this respect, the holding frame is designed to hold the expansion tank above the cooling module detachably connected to the housing. By way of example, the holding frame has a bottom side facing a foundation or base and an upper top side facing away therefrom, which is connected directly to the expansion tank. Extending between these two sides, there are, for example, metal struts, which are connected to one another in such a way that a required free space to accommodate the cooling module is provided, said cooling module likewise being secured on the housing or on the holding frame.

The holding frame is expediently part of the cooling module, wherein the cooling module is connected to the housing via the holding frame.

Further advantages are obtained if the cooling module has a holding frame that is equipped with a lifting grip for raising the holding frame and a hook part for hooking into a mating part secured on the housing. The lifting grip is, for example, a lifting lug in the form of a closed ring which has an inside diameter that allows a conventional crane hook to be hooked in and thus allows the holding frame and thus the entire cooling module to be lifted easily. As a departure from this, the lifting grip is likewise of hook-shaped design. The hook part and the mating part, e.g. a simple pin, form a hook joint which allows the cooling module to be hooked into the housing and thus allows rapid installation of the cooling module. The mating part is, for example, a pin that extends parallel to a housing wall, e.g. the cover, and is held at a distance from said housing wall.

According to an advantageous development, each single-phase transformer can be connected to an auxiliary current module, in which an auxiliary transformer for producing a supply power is arranged. According to this advantageous development, an auxiliary current module is provided which is connected to the active part and, for example, to a stabilizing or tertiary winding of the respective transformer. When the single-phase transformer is connected to the network, the higher-voltage winding of the auxiliary transformer is excited, with the result that the supply voltage required by electric components of the single-phase transformers for the operation thereof is made available at the secondary side of said transformer. These electric components comprise motors, pumps, fans, ventilation systems and the like, for example.

It is advantageous if at least three bushing sockets are provided. It is advantageous if the bushing sockets are secured air- and liquid-tightly on the housing. They each allow rapid insertion of the high-voltage bushing associated therewith and thus allow rapid on-site assembly. By virtue of the provision of at least three bushing sockets, the arrangement can be operated with several input voltages and can thus be used in a more flexible way. The bushing sockets are designed to have a shape complementary to that of the plug-in section of the respective high-voltage socket. In this arrangement, the high-voltage bushing is dimensioned according to its operating voltage.

According to a preferred embodiment, each winding connection lead is equipped with a current transformer. According to this embodiment, the mounting of current transformers during on-site assembly is avoided. According to this embodiment, the current transformers are installed in a fixed manner within the housing. This leads to a further shortening of the on-site assembly time.

It is expedient if the cooling module is equipped with a fan and can be connected to the auxiliary current module. According to this advantageous embodiment, an active cooling module is chosen which provides a higher rate of cooling than a passive cooling module of comparable dimensions. To supply the fan with power, the cooling module is connected to the auxiliary current module, which makes available on the output side the supply voltage for the fans and other electronic elements of the cooling module.

In another embodiment of the arrangement according to the invention, at least one closable setting opening is formed in the housing, said opening allowing access to a selection device arranged in the housing, wherein the selection device forms a plurality of voltage terminals, which are each connected to an associated bushing socket, a cable outlet or a winding, wherein two of the voltage terminals can be connected selectively to one another by means of a switchover unit. According to this advantageous development, the single-phase transformers can be set to particular inputs or outputs. For this purpose, one voltage terminal of each selection unit is connected to one winding. The other voltage terminals of the selection unit are each connected to an associated bushing socket or a cable connection. By means of the switchover unit, a selected input or output of the single-phase transformer is connected to one of the windings. The switchover unit is, for example, a switch of appropriate design or, alternatively, a low-cost connecting conductor that can be plugged in at both ends, referred to below as a setting conductor. By simply reconnecting the setting conductor, the respective winding is connected to a different bushing socket. In this way, the inputs and outputs can be set in a flexible way. The selection device is arranged within the housing and is thus completely surrounded by insulating fluid during the operation of the arrangement. However, it is directly adjacent to a setting opening in the housing. This setting opening is preferably situated in the "cover" of the housing. In order, for example, to connect a particular bushing socket designed for a higher voltage to the higher-voltage winding, some insulating fluid is drained off from the housing, allowing a user to access the selection device via the setting opening. The setting conductor can then connect the corresponding voltage terminals of the selection device to one another.

According to a development which is expedient in this respect, an input setting opening and an output setting opening are provided, wherein the selection device adjacent to the input setting opening is connected to at least two bushing sockets, and the selection device adjacent to the output setting opening is connected to a further bushing socket and to one or each cable outlet. In other words therefore, it is thus possible for the arrangement according to the invention to be set up both for certain high voltages on the input side and furthermore for various outputs to be occupied as well. For example, the lower-voltage winding can be connected selectively to a bushing or to a cable outlet via the output setting opening.

It is expedient if each high-voltage bushing is equipped with a fastening connection for mounting on the housing, from which connection there extends a column section forming, at its free end remote from the fastening connection, a high-voltage terminal, wherein the column section has a length of at least three meters. According to this embodiment, plug-in bushings in a voltage range of over 245 kV are made possible. Plug-in bushings in this voltage range are not currently known.

It is expedient if at least one cable connection is provided for the connection of a cable conductor. It is advantageous if the housing has two cable connections.

The invention also relates to a method for replacing a multiphase transformer. In the method, a number of single-phase transformer housings corresponding to the number of phases of the multiphase transformer is set up in the vicinity of the multiphase transformer, the transformer housings are connected to a cooling module and to an expansion tank, high-voltage bushing sockets of the transformer housing are installed, the windings of the single-phase transformer housings are interconnected, and the high-voltage bushing is connected at the terminals thereof to a supply network and to a load.

As already explained in connection with the arrangement according to the invention, transportation and assembly time are considerably reduced both through the modular construction and through the selection of a number of modularly single-phase transformers, making it possible to quickly resume the supply to public or domestic consumers after a failure of a multiphase transformer.

Further expedient embodiments and advantages of the invention form the subject matter of the following description of illustrative embodiments of the invention with reference to the figures of the drawing, wherein the same reference signs refer to components that have the same action.

DESCRIPTION OF THE INVENTION

Figure 1:
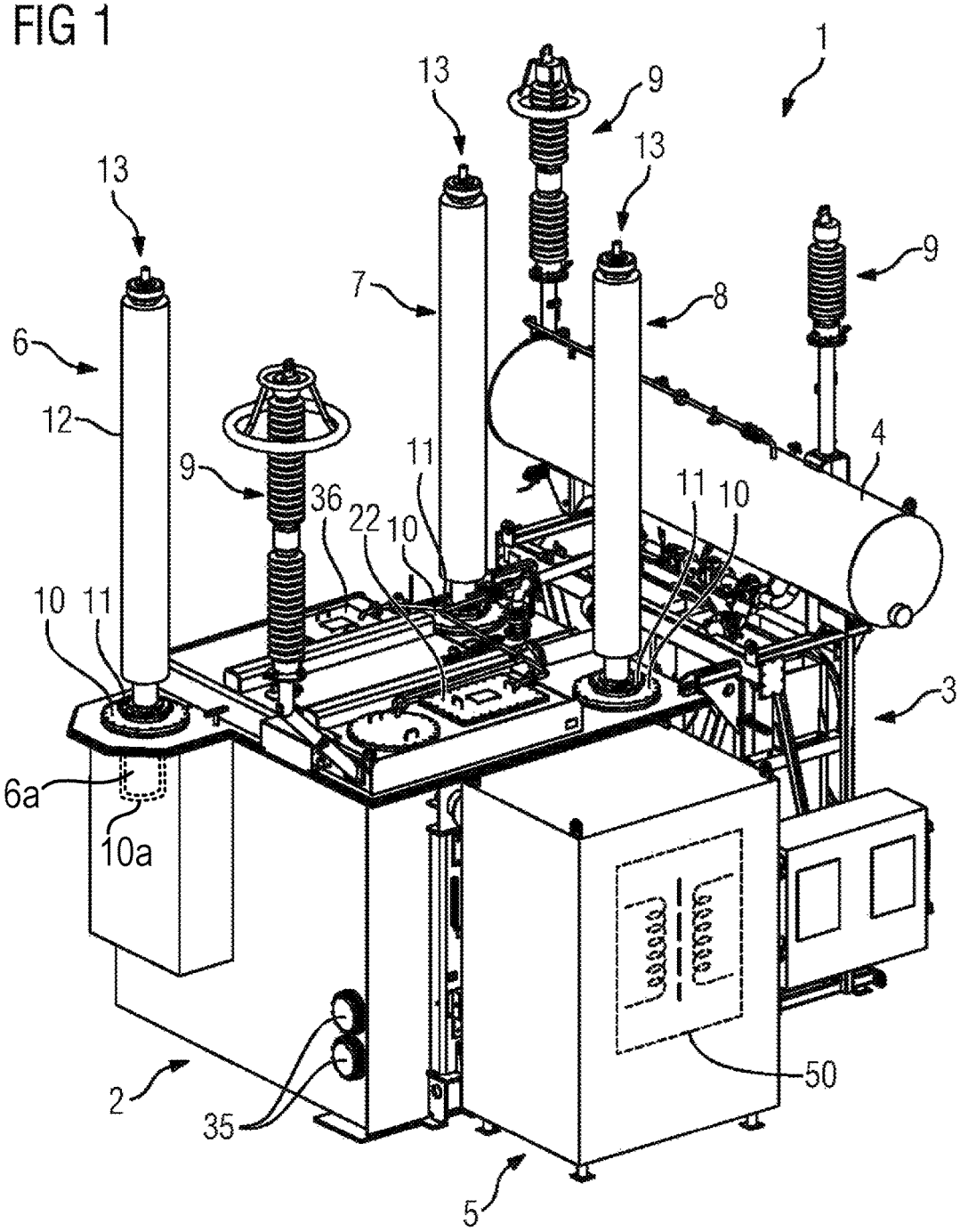
FIGS. 1, 2 show a single-phase transformer in one illustrative embodiment of the arrangement according to the invention in a perspective view.

FIG. 1 shows an illustrative embodiment of a single-phase transformer 1 of an arrangement according to the invention in a perspective view. The transformer 1 shown there has a housing 2, which is equipped with a cooling module 3, an expansion tank 4, an auxiliary current module 5 and high-voltage bushings 6, 7, 8. Said components or modules are connected detachably to one another and can thus be removed easily and transported independently of one another. To protect the high-voltage bushings 6, 7 and 8 and the active part of the transformer 1, which is arranged in the housing, i.e. the higher-voltage winding, which is connected to the high-voltage bushing 6 or 7, and the lower-voltage winding, which is connected to the high-voltage bushing 8, and the core, the legs of which are enclosed by respective windings, use is made of arresters 9, which, within the arrestor housing thereof, have a nonlinear resistor which transfers from a nonconductive state to a conductive state in the presence of overvoltages and thus protects the components connected in parallel therewith.

The high-voltage bushings 6, 7 and 8 are each designed as plug-in high-voltage bushings and can be introduced by means of the plug-in end 6*a* thereof into matching bushing sockets 10. Like the plug-in end 6*a*, the bushing sockets 10 are of rotationally symmetrical design and delimit a cavity 10*a*, which is open toward the housing cover but closed at one end and the shape of which is complementary to that of the plug-in end 6*a* of the respective high-voltage bushing 6, 7, 8. The bushing sockets 10 are furthermore connected fluid-tightly to the housing 2, with the result that the oil chamber of the single-phase transformer 1 is sealed off hermetically, i.e. air- and liquid-tightly, from the external atmosphere. A current-conducting stud (not visible in the figures) is held on the closed end of the bushing socket, and, when the high-voltage bushing 6, 7 or 8 is introduced into the respective bushing socket 10, said stud is in conducting contact with the high-voltage conductor extending through the respective high-voltage bushing 6, 7, 8. Said conducting stud extends into the interior of the housing 2, i.e. into the oil chamber thereof, where it is in contact with a winding connection lead, which thus connects the bushing sockets electrically to the respective higher- or lower-voltage winding of the transformer.

For the mounting and fixing of the high-voltage bushing 6, 7 or 8, each of said bushings has a fastening connection 11. A column section 12 extends from the fastening connection 11 to a high-voltage terminal 13, which is an open-air terminal in the illustrative embodiment shown. In the illustrative embodiment shown, the distance between the fastening connection 11 and the high-voltage terminal 13 is over 2 meters and, in particular, over 3 meters.

Figure 2:
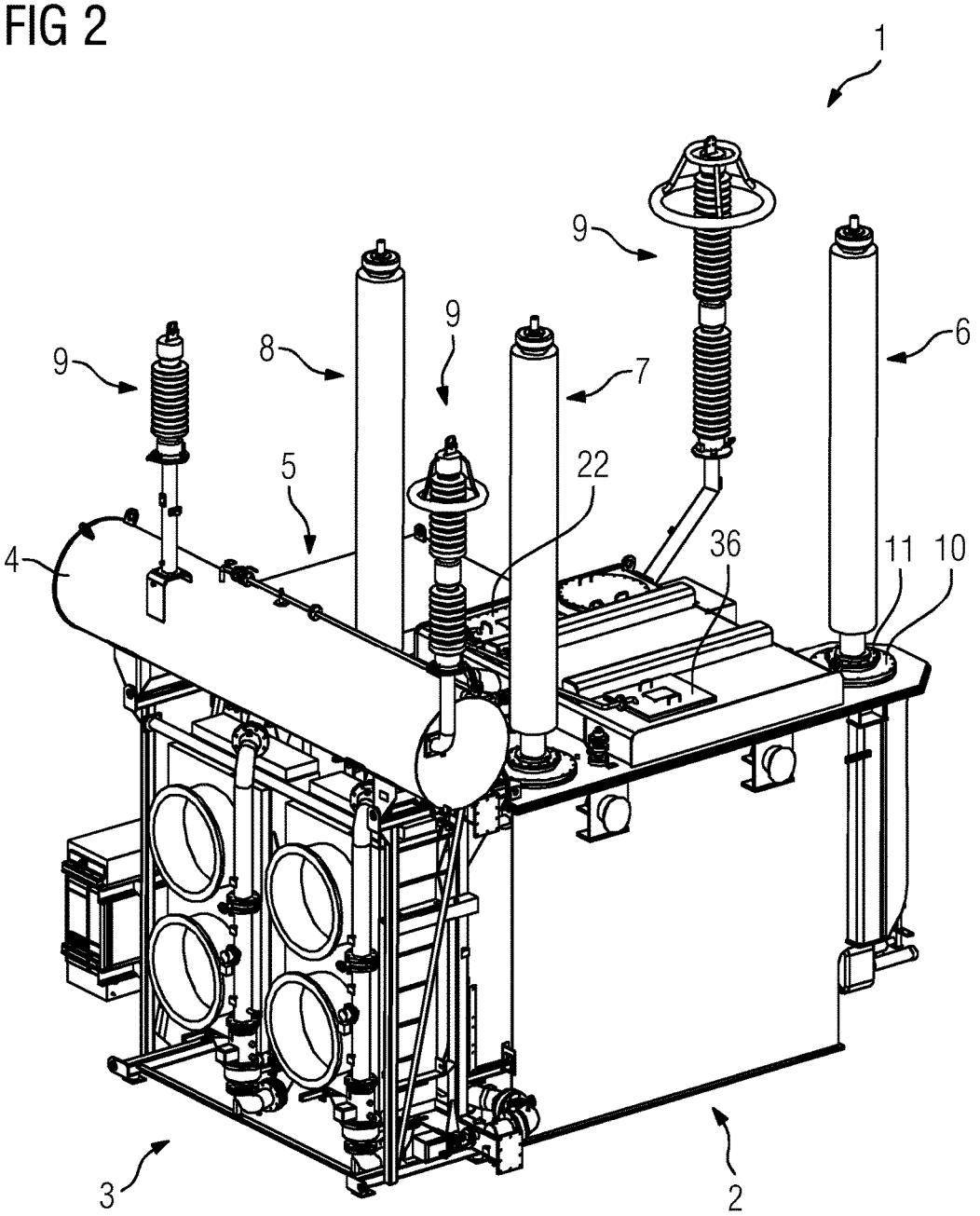

FIG. 2 shows the single-phase transformer 1 according to FIG. 1 in a perspective view, in which the cooling module is more readily visible. In other respects, the statements made with respect to FIG. 1 apply in corresponding fashion here.

Figure 3:
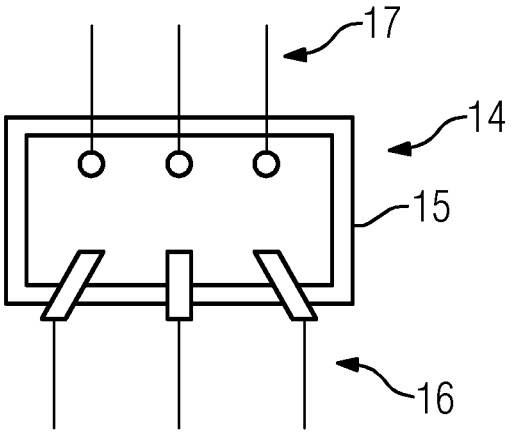
FIG. 3 illustrates schematically a faulty multiphase transformer during operation.

FIG. 3 shows a three-phase transformer 14 in a plan view, said transformer being arranged on a foundation made of concrete 15. On the hyper-voltage side, the transformer 14 is connected to a high-voltage supply network 16, which has three phases. A consumer network 17 is indicated on the lower-voltage side. If the multiphase transformer 14 fails, the power supply to the consumer network 17 by the supply network 16 can no longer be maintained. Rapid replacement of the multiphase transformer 14 must therefore be ensured. However, the multiphase transformer 14 is a power transformer, the customized production of which generally takes several months, e.g. 10-15 months. In addition, there is expensive transportation and, finally, on-site assembly, which likewise takes several weeks.

Figure 4:
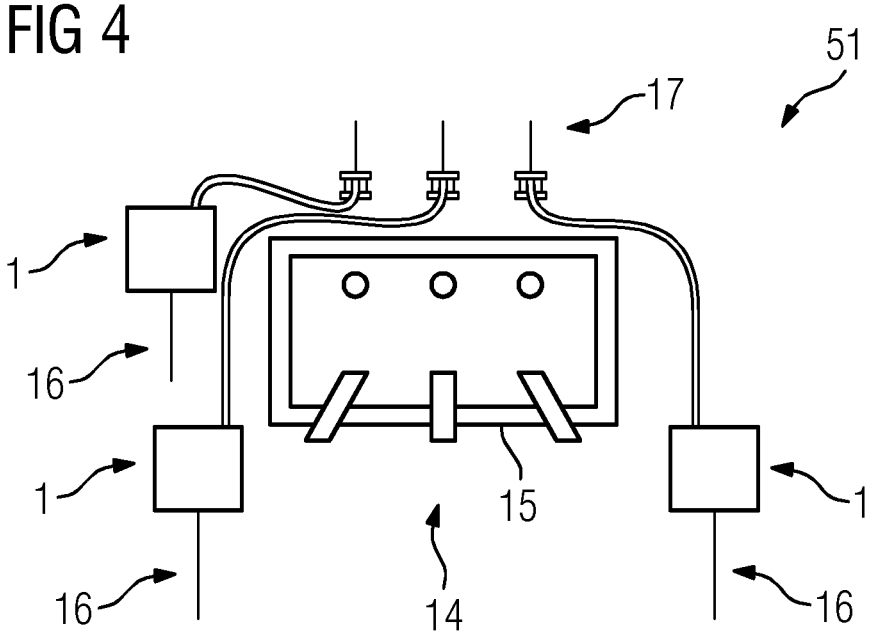
FIG. 4 shows the arrangement according to the invention as a replacement for the faulty multiphase transformer shown in FIG. 3.

FIG. 4 shows the use of an arrangement 18 according to the invention for replacing the multiphase transformer 14. It is evident that the arrangement 51 consists of a plurality of single-phase transformers 1, as shown in FIGS. 1 and 2. The single-phase transformers 1 are each connected on the higher-voltage side, that is to say, for example, by means of the open-air terminal 13 of bushing 6, to the supply network 16 and, on the lower-voltage side thereof, via a cable connection and an open-air terminal, to the consumer network 17. The arrangement 51 according to the invention is of flexible design and can therefore be set up to match the respective requirements. The arrangement 51 according to the invention can therefore be constructed even before the occurrence of a fault. Owing to its modular construction and the use of single-phase transformers 1, the arrangement 51 according to the invention consists of individual components that are light in comparison with the multiphase transformer 14 and can be transported to the respectively desired setup location in a considerably shorter time. By virtue of the modular construction, the assembly time is moreover considerably shorter, and therefore the arrangement 18 according to the invention can be assembled within a few days, thus allowing the supply to the consumer network to be resumed quickly. It is then possible to seek a permanent replacement solution for the multiphase transformer 14. For example, a new multiphase transformer can be designed and produced. The faulty multiphase transformer 14 can be removed from the foundation 15 and the new multiphase transformer can be set up there. The supply network 16 and the consumer network 17 are then connected to the new multiphase transformer, and the latter therefore then provides the desired voltage conversion instead of the arrangement 51 according to the invention. The arrangement 51 according to the invention can then be disassembled and used for new tasks.

Figure 5:
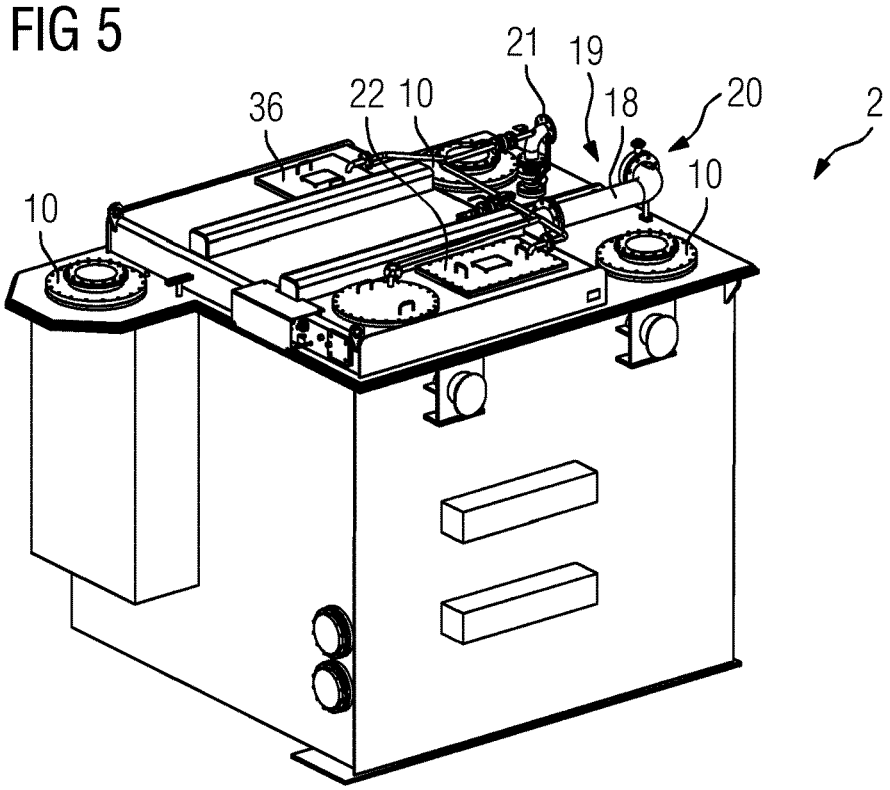
FIG. 5 illustrates the housing of a single-phase transformer in a perspective view.

FIG. 5 shows the housing 2 of a single-phase transformer 1 in a perspective illustration. Here, the bushing sockets 10 are particularly clearly visible. Also illustrated is a pipe 18, which is used to connect the housing 2 to the cooling module 3. For this purpose, the pipe 18 forms an opening 19, which can be closed fluid-tightly by means of a closing valve 20. Moreover, a connection stub 21 for connection to the expansion tank 4 is illustrated.

Figure 6:
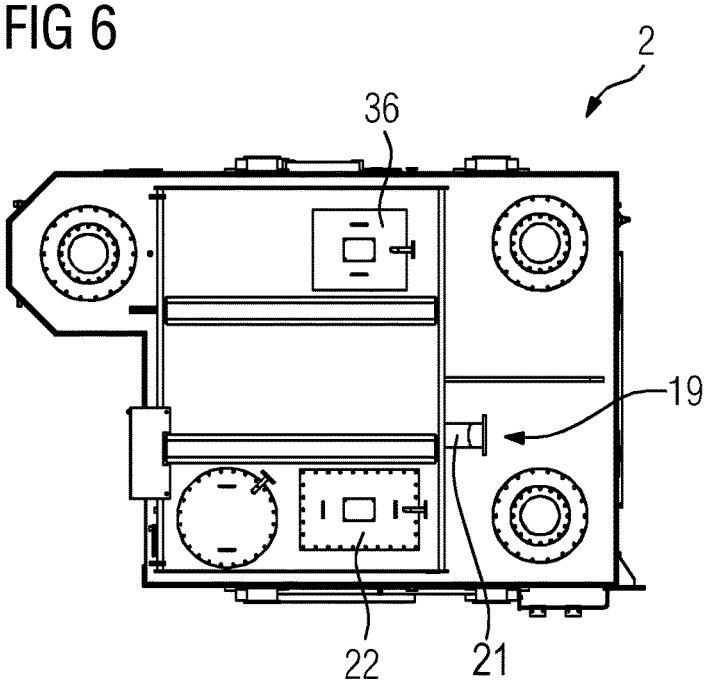
FIG. 6 shows the housing according to FIG. 5 in a plan view.

In FIG. 6, the housing 2 according to FIG. 5 is shown in a plan view. In particular, FIG. 6 illustrates setting openings 22, 36, which can be closed fluid-tightly by means of a flap. The setting openings 22 and 33 each allow access to a selection device, further details of which will be given below. In FIG. 6, illustration of the pipe 18 has been omitted, and therefore only a connection stub 21 can be seen, in which, in turn, an opening 19 is formed, which again can be closed by means of a closing valve. Thus, unwanted emergence of insulating fluid from the housing 2 during transportation is avoided.

Figure 7:
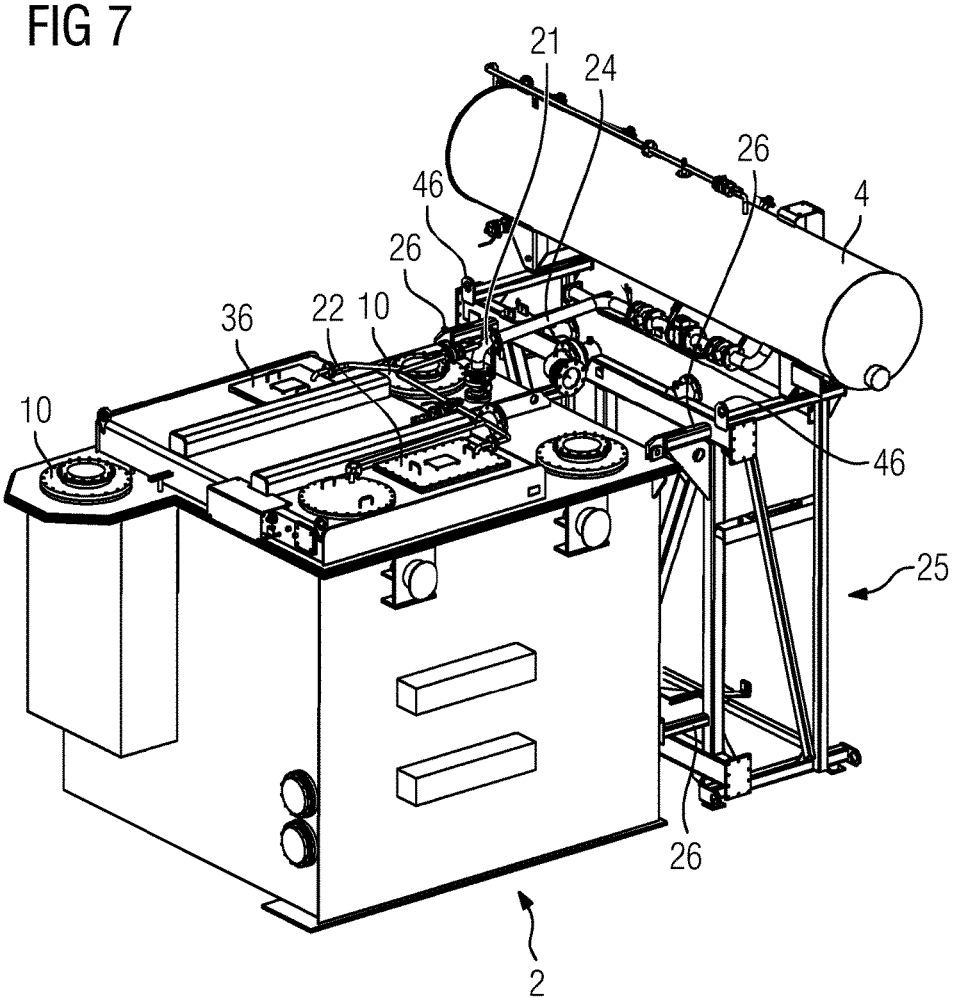
FIG. 7 depicts the housing according to FIG. 5 together with the expansion tank arranged on a holding frame and connected to the housing.

FIG. 7 shows the housing 2 according to FIGS. 5 and 6, although here the expansion tank 4 is connected by a pipe 24 to the connection stub 21 and thus to the oil chamber of the housing 2. In other words, as temperatures increase, the expanding insulating fluid can pass via a connection comprising a connection stub 21 and connection pipe 24 into the expansion tank 4. It can furthermore be seen in FIG. 7 that the expansion tank 4 is arranged on a separately erected frame 25. The entire weight of the expansion tank 4 is thus introduced into the frame 25 and not into the housing 4. The holding frame 25 is connected to the housing 2 by means of a hook joint, thus avoiding the holding frame 25 accidentally slipping sideways off the housing 2. The hook joint comprises a hook part 26 which is connected in a fixed manner to the holding frame 25 and engages in a mating part fixed on the housing 2. The mating part is, for example, a pin extending parallel to the housing cover and connected to the housing cover by means of two lateral legs, wherein the lateral legs and the pin have the form of an inverted "U".

Figure 8:
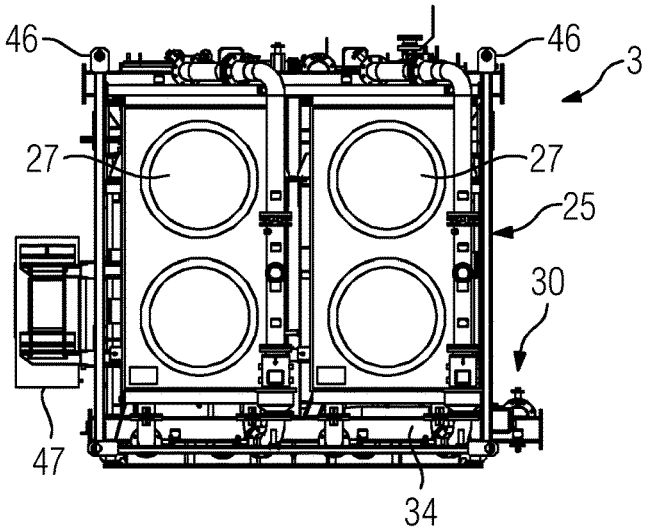
FIG. 8 shows an illustrative embodiment of a cooling module in a front view.

FIG. 8 shows the cooling module 3 in a front view, in which it can be seen that the cooling module 3 has fans 27, by means of which the cooling capacity of the cooling module 3 can be increased. The fans 27 produce an air flow, which is guided past the outside of a heat exchanger array (not shown in the figures) of the cooling module 3. The insulating fluid circulates within the heat exchanger array, and there is heat exchange between the heated insulating fluid and the air flow flowing past. In other words, heat is transferred from the insulating fluid to the air flow and can thus be dissipated to the external atmosphere. The cooling module 3 is likewise held in the frame 25. As already described, the frame 25 forms a hook part 26 for a hook joint with the housing 2, allowing the frame 23 and thus the cooling module 3 to be hooked easily onto the housing. To enable it to be lifted with a lifting crane, the holding frame 25 furthermore forms lifting lugs 46. Moreover, the cooling module 3 comprises a control unit 47, which is integrated in a fixed manner into the cooling module 3. The fixed connection simplifies and accelerates the mounting of the cooling module 3 on the housing 2.

Figure 9:
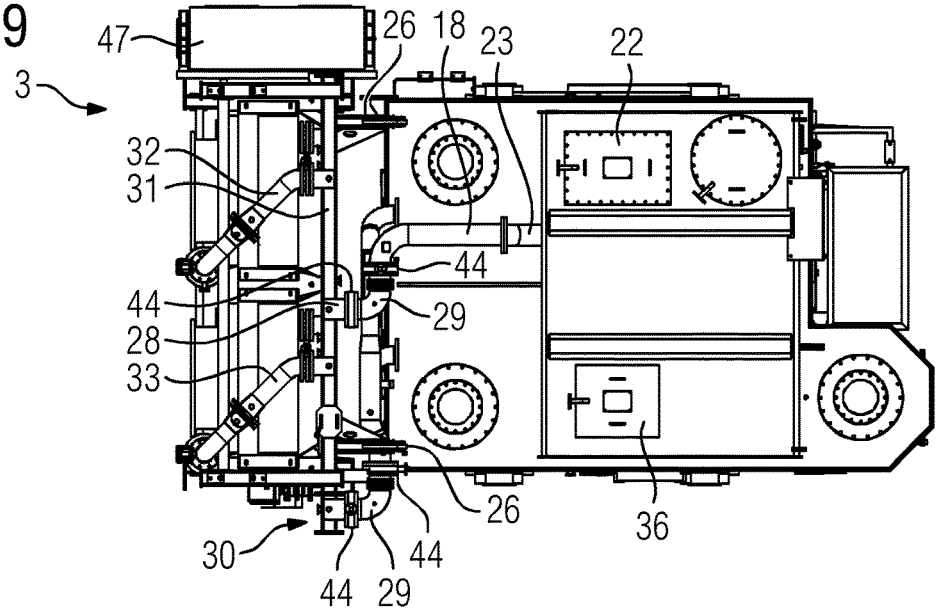
FIG. 9 shows the cooling module according to FIG. 8 connected to the housing according to FIG. 5 in a plan view.

It can furthermore be seen in FIG. 9 that the cooling module 3 forms a connection piece 28 in the upper region thereof, said connection piece being connected by means of an intermediate piece 29 to the pipe 18 and thus to the connection stub 23 of the housing 2. The connection piece 28 forms a cooling fluid inlet of the cooling module 3, whereas the pipe 18 forms a cooling fluid outlet of the housing 2. In the lower region of the cooling module, FIG. 8 shows an output stub 30, which delimits a cooling fluid outlet of the cooling module 3. Via a further intermediate piece 29, the cooling fluid outlet 30 of the cooling module 3 is connected to a cooling fluid inlet (not shown in the figures) of the housing 2, in the lower region thereof, allowing circulation of insulating fluid via the cooling module 3. The connection piece 28, the pipe 18, the output stub 30 and the cooling fluid inlet (not shown) of the housing 2 are each equipped with a closing valve 44, by means of which the respective outlet or inlet can be closed in a fluid-tight manner.

It can likewise be seen from FIGS. 8 and 9 that the cooling module 3 shown is split into two parts and, for this reason, the connection piece 28 is connected to an upper manifold 31 extending in the transverse direction, which is connected, in turn, to two pipes 32 and 33, enabling cooling to be split between two cooling sections. A lower manifold 34 can be seen below the fans 27 in FIG. 8, said manifold uniting the two insulating fluid streams and feeding them to the outlet stub 30.

FIG. 9 shows the cooling module 3 from above, wherein it is hooked firmly to the housing 2 by means of a hook joint. At the same time, it is arranged in the holding frame 25.

Figure 10:
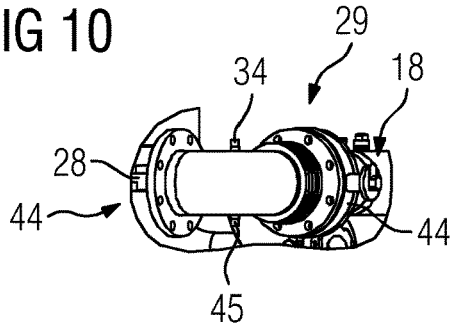
FIG. 10 illustrates an illustrative embodiment of an intermediate piece for connection of the cooling module.

The intermediate piece 29 is illustrated in detail in FIG. 10. It can be seen that the intermediate piece 29 is of angled design. It is internally hollow or tubular and delimits a connecting channel, which can be bled by means of a bleed connection 34. A hose connection, for example, can be set up at the bleed connection 34, said hose connection being connected to an appropriate vacuum pump, thus making it possible to bleed the connecting channel of the intermediate piece 29, which extends between the closing valves of the pipe 18 and the connection piece 28. After the application of the vacuum, the closing valves can be opened, wherein contamination of the insulating fluid by air and/or water inclusions is avoided. The intermediate piece 29 is furthermore equipped with a drain opening 45 for draining off insulating fluid from the connecting channel before disassembly.

Figure 11:
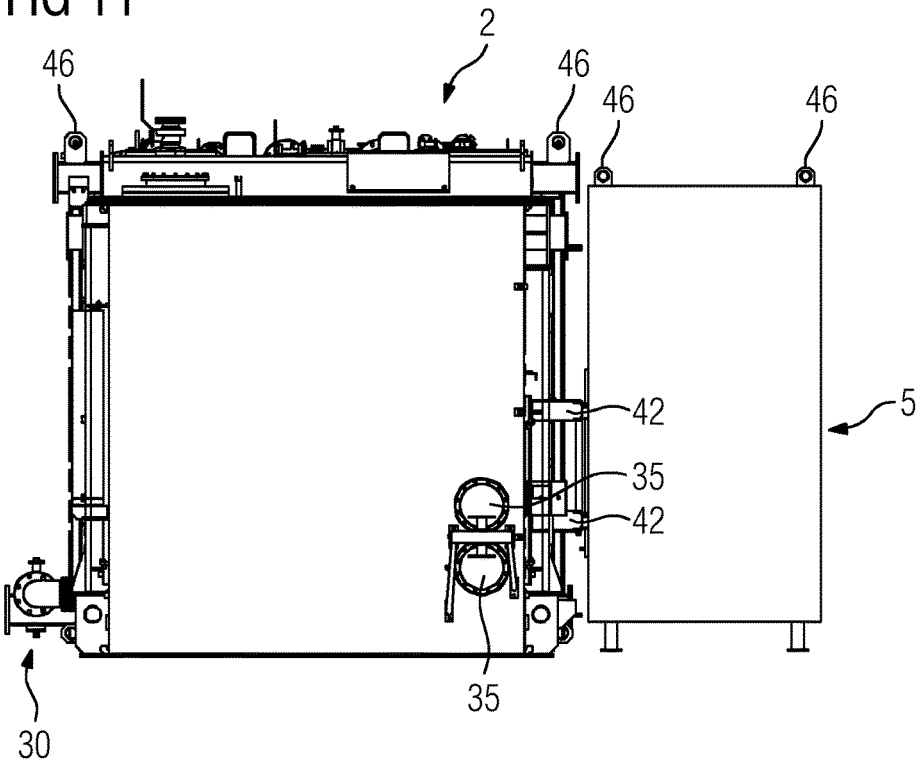
FIG. 11 shows the housing with the auxiliary current module connected in a side view.

FIG. 11 shows the mounting of the auxiliary current module 5 on the housing 2 by means of a mechanical connecting unit 42. By means of an electrical connection (not shown in the figures), the auxiliary current module 5 is connected to a tap of a stabilizing or tertiary winding of the housing 2, in this way ensuring that a voltage is applied to the input of the auxiliary current module 5 during the operation of the respective single-phase transformer 1. The auxiliary current module 5 has an auxiliary transformer 50, which is connected by means of its higher-voltage winding to the input of the auxiliary current module 5 and, on the output side, makes available a supply voltage which can be used, for example, to drive the fans 27 of the cooling module 5. For this purpose, the auxiliary current module 5 is connected to the cooling module by electrical connection leads (not shown).

The connecting unit 42 is a detachable mechanical connection which makes it possible to connect the auxiliary current module 5 simply, quickly and reliably to the housing 2. A plug-in, clamping, hook, flange or other joint may be considered here, for example.

Figure 12:
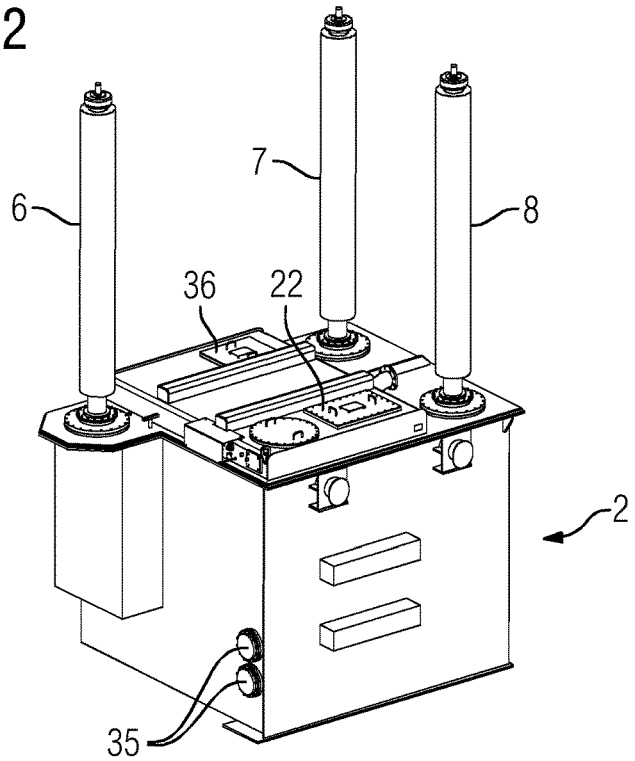
FIG. 12 illustrates the housing with inserted high-voltage bushings.

FIGS. 12 to 17 illustrate the flexibility of the arrangement 51 according to the invention and, in particular, indicate that the arrangement 51 can be used variably at different voltage levels. In FIG. 12, the housing 2 is illustrated with all the plug-in high-voltage bushings 6, 7 and 8, as shown in FIG. 1. In addition, a cable connection 35 of redundant design can be seen, allowing two cable conductors to be connected. It can furthermore be seen that the housing 2 has an output setting opening 22 and an input setting opening 36. Both the input setting opening 36 and the output setting opening 22 are closed fluid-tightly by a cover.

Figure 13:
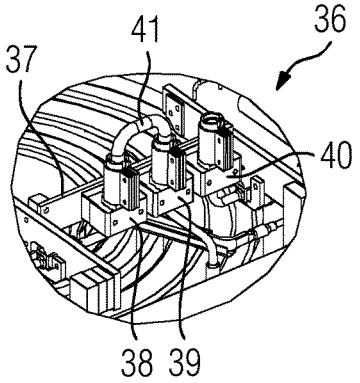
FIGS. 13, 14 and 15 show illustrative embodiments of voltage selection devices.

In FIG. 13, it is possible to see into the input setting opening 36, allowing the selection device 37 adjacent thereto to be seen. The selection device 37 has voltage terminals 38, 39 and 40. With the aid of a U-shaped setting conductor 41, two of the voltage terminals 38 and 39 are connected to one another. By means of this setting, the higher-voltage winding of the transformer 1 is connected to the bushing socket 10 of high-voltage bushing 6 and is thus set up for an input voltage of 345 kV. The output of a voltage of, for example, 138 kV takes place at high-voltage bushing 8. In the operating mode thus set, high-voltage bushing 7 can be omitted.

Figure 16:
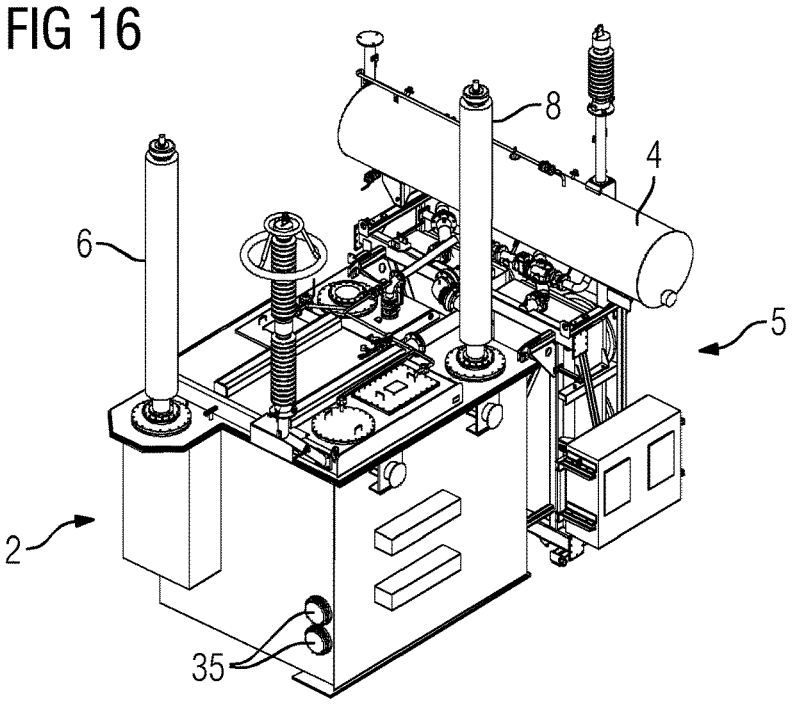
FIG. 16 shows an illustrative embodiment of a single-phase transformer of the arrangement according to the invention, which has been set up for an input voltage of 345 kV and an output voltage of 138 kV.

FIG. 16 illustrates the embodiment of the housing 2 with the cooling module 5, expansion tank 4 and the two high-voltage bushings 6 and 7, this being the embodiment obtained with an input setting according to FIG. 13.

Figure 14:
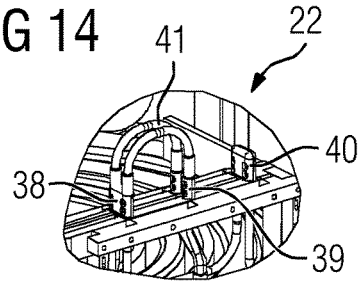
Figure 15:
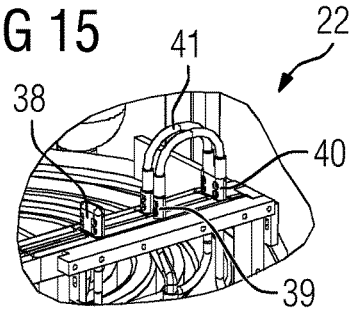

FIG. 14 illustrates a view into the input setting opening 22, wherein, once again, a selection device 37 with its three voltage terminals 38, 39 and 40 can be seen. In FIG. 14, the connecting conductor 41 connects voltage terminals 38 and 39, ensuring that voltage is output at high-voltage bushing 8. FIG. 15 shows a setting in which the connecting conductor 41 connects terminals 39 and 40. In the setting thus shown, the voltage at cable connection 35 drops, and therefore high-voltage bushing 8 can also be omitted.

Figure 17:
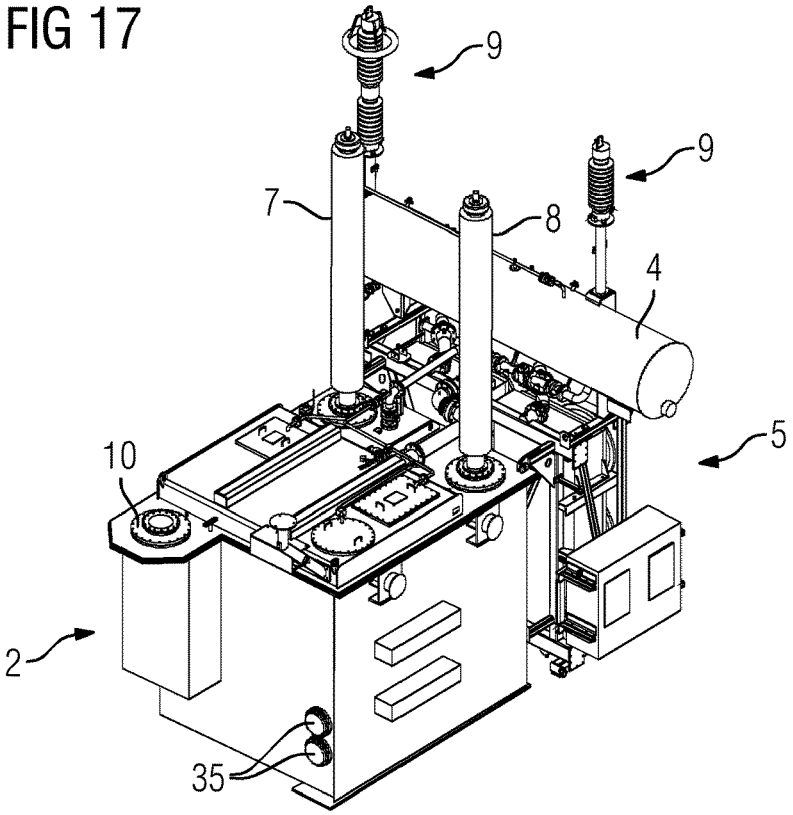
FIG. 17 illustrates an illustrative embodiment of a single-phase transformer of the arrangement according to the invention with an input voltage of 330 kV and an output voltage of 115 kV.

FIG. 17 shows a configuration of the transformer 1 in which the connecting conductor 41 of the selection device 22 connects voltage terminals 39 and 40. In this setting, the transformer is set up for higher voltages of 230 kV, wherein a voltage of 115 kV can be tapped off at high-voltage bushing 8 or at the cable connection.

The invention claimed is:

1. A configuration for replacing a multiphase transformer, the configuration comprising:

a plurality of single-phase transformers each including a housing filled with an insulating fluid and a core having a higher-voltage and a lower-voltage winding disposed in said housing;

at least one bushing socket connected by a winding connection lead extending within said housing to said higher-voltage or lower-voltage winding, said at least one bushing socket connected to the winding connection lead at an end adjacent to the insulating fluid;

at least one high-voltage bushing being insertable into said at least one bushing socket, said bushing socket being complementary in shape to an insertion end of the high-voltage bushings; and a cooling module for cooling the insulating fluid, the cooling module detachably connected to said housing and being filled with the insulating fluid, said cooling module configured to hold said insulating fluid in said cooling module even when said cooling module is detached from said housing.

2. The configuration according to claim 1, wherein both of said housing and said cooling module have at least one cooling fluid inlet and at least one cooling fluid outlet to be connected to one another for an exchange of insulating fluid, and said at least one cooling fluid outlet and said at least one cooling fluid inlet each being equipped with a respective fluid-tight closing valve.

3. The configuration according to claim 2, which further comprises an intermediate piece for a fluid-tight connection of said at least one cooling fluid outlet and said at least one cooling fluid inlet, said intermediate piece delimiting a connecting channel and having a bleed opening for bleeding said connecting channel.

4. The configuration according to claim 1, which further comprises:

a holding frame being separate from said housing;

an expansion tank disposed on said holding frame; and a connection for connecting said expansion tank to said housing for an exchange of insulating fluid.

5. The configuration according to claim 4, wherein said holding frame is configured to hold said expansion tank above said cooling module being detachably connected to said housing.

6. The configuration according to claim 1, which further comprises a plurality of auxiliary current modules each having a respective auxiliary transformer disposed therein for producing a supply power, said auxiliary current modules each configured to be connected to a respective one of said single-phase transformers.

7. The configuration according to claim 6, wherein said cooling module is one of a plurality of cooling modules each being equipped with a respective fan and each being configured to be connected to a respective one of said plurality of auxiliary current modules.

8. The configuration according to claim 1, wherein said at least one bushing socket includes at least three bushing sockets.

9. The configuration according to claim 1, wherein each said winding connection lead is equipped with a respective current transformer.

10. The configuration according to claim 1, wherein:

said at least one bushing socket includes a plurality of bushing sockets;

said housing has cable outlets;

a selection device is disposed in said housing, said selection device has a plurality of voltage terminals each being connected to a respective one of said bushing sockets, a respective one of said cable outlets or a respective one of said windings;

said housing has at least one closable setting opening formed therein allowing access to said selection device; and a switchover unit for selectively connecting two of said voltage terminals to one another.

11. The configuration according to claim 10, wherein:

said at least one closable setting opening includes an input setting opening and an output setting opening;

said selection device is one of two selection devices;

one of said selection devices is adjacent said input setting opening and is connected to said higher-voltage winding and to at least two of said bushing sockets; and another of said selection devices is adjacent said output setting opening and is connected to said lower-voltage winding, to at least one of said bushing sockets and to one or each of said cable outlets.

12. The configuration according to claim 1, wherein:

said at least one high-voltage bushing includes a plurality of high-voltage bushings;

each of said high-voltage bushings is equipped with a respective fastening connection for mounting on said housing, each high-voltage bushing additionally including a column section extending from said respective fastening connection;

each said column has a length of at least three meters and each has a respective free end facing away from said respective fastening connection; and high-voltage terminals are each disposed at a respective one of said free ends.

13. The configuration according to claim 1, which further comprises at least one cable connection configured to connect to a cable conductor.

14. A configuration for replacing a multiphase transformer, the configuration comprising:

a plurality of single-phase transformers each including a housing filled with an insulating fluid and a core having a higher-voltage and a lower-voltage winding disposed in said housing;

at least one bushing socket connected by a winding connection lead extending within said housing to said higher-voltage or lower-voltage winding, said at least one bushing socket connected to the winding connection lead at an end adjacent to the insulating fluid;

at least one high-voltage bushing being insertable into said at least one bushing socket, said bushing socket being complementary in shape to an insertion end of the high-voltage bushings, said at least one high-voltage bushing being configured for use with a voltage range of over 245 kV; and a cooling module for cooling the insulating fluid, the cooling module detachably connected to said housing and being filled with the insulating fluid, said cooling configured to hold said insulating fluid in said cooling module even when said cooling module is detached from said housing.

* * * * *